United States Patent [19]

Panetti

[11] Patent Number: 4,993,193

[45] Date of Patent: Feb. 19, 1991

[54] RAILROAD VEHICLE FOR REPROFILING AT LEAST ONE RAIL OF A RAILROAD TRACK

[75] Inventor: Romolo Panetti, Geneva, Switzerland

[73] Assignee: Speno International S.A., Geneva, Switzerland

[21] Appl. No.: 446,199

[22] Filed: Dec. 5, 1989

[30] Foreign Application Priority Data

Mar. 2, 1989 [CH] Switzerland ..... 765/89

[51] Int. Cl.[5] ..... B24B 23/00; B24B 27/08

[52] U.S. Cl. ..... 51/178

[58] Field of Search ..... 51/178, 241 G, 40, 38, 51/98 R, 98.5

[56] References Cited

U.S. PATENT DOCUMENTS

| | | | |
|---|---|---|---|
| 3,738,066 | 6/1973 | Panetti . | |
| 3,888,052 | 6/1975 | Panetti . | |
| 4,074,468 | 2/1978 | Panetti . | |
| 4,115,857 | 9/1978 | Panetti . | |
| 4,189,873 | 2/1980 | Panetti . | |
| 4,309,847 | 1/1982 | Panetti . | |
| 4,416,091 | 11/1983 | Panetti . | |
| 4,492,059 | 1/1985 | Panetti . | |
| 4,596,092 | 6/1986 | Panetti . | |
| 4,615,150 | 10/1986 | Panetti | 51/178 |
| 4,621,460 | 11/1986 | Scheuchzer et al. | 51/178 |
| 4,622,781 | 11/1986 | Vieau et al. | 51/241 G |
| 4,878,318 | 11/1989 | Panetti | 51/178 |
| 4,896,460 | 1/1990 | Theurer et al. | 51/178 |
| 4,920,701 | 5/1990 | Panetti | 51/168.71 |

FOREIGN PATENT DOCUMENTS 666068 6/1988 Switzerland .

*Primary Examiner*—Frederick R. Schmidt
*Assistant Examiner*—Mark A. Morris
*Attorney, Agent, or Firm*—Young & Thompson

[57] ABSTRACT

Railroad vehicle for the reprofiling of at least one rail of a railway track, includes a frame provided with wheels resting on each rail. At lest two reprofiling units are supported by the frame, having each a motor, the shaft of which carries at each end a rotative tool. A support carries the grinding units; and the support is connected to the frame in such a way as to permit displacing the support vertically and transversely with respect to the frame. The reprofiling units comprise further structure to apply one of their tools against a rail. The support is displaceable with respect to the frame in rotation and-/or translation. Each reprofiling unit is mounted on the support by a rotating table the rotation axis of which is perpendicular to the axis of rotation of the motor of the unit and by a slide extending perpendicularly to the longitudinal axis of the rail so that the motor shafts of the motors of the two grinding units can be displaced the one with respect to the other, firstly, in rotation around an axis parallel to the longitudinal axis of the rail, and secondly, in translation parallel to a plane which is perpendicular to the longitudinal axis of the rail.

4 Claims, 4 Drawing Sheets

RAILROAD VEHICLE FOR REPROFILING AT LEAST ONE RAIL OF A RAILROAD TRACK

The present invention has for its object a railroad vehicle for reprofiling at least one rail of a railroad track, this reprofiling being made more particularly by using grinding units. There are numerous reprofiling vehicles comprising individual or groups of grinding units mounted on carriages resting, at work, on the track by means of rollers. These carriages are displaceable in height with respect to the frame of the vehicle and the grinding units are generally angularly tiltable with respect to the carriage around an axis which is parallel to the railroad track. Each grinding unit comprises at least one motor the shaft of which is provided at each of its ends with a rotative grinding stone intended to alternately cooperate with the rail to be rectified. These grinding units comprise means to displace the motor or motors and their grinding wheels in order to displace the grinding wheel towards the rail, to apply it against the rail with a given force or to displace it away from said rail.

Certain machines enable an individual angular adjustment of each motor with respect to the carriage as well as an angular adjustment of the grinding unit as a whole increasing the number lines along the head of the rail that can be ground.

Other railroad vehicles have grinding units which can move in a coordinate angular movement around an axis parallel to the track as well as perpendicularly to said axis.

Such railroad vehicles and/or grinding units are for example described in the following U.S. Pat. Nos.: 3,738,066; 3,888,052; 4,189,893; 4,309,847; 4,074,468; 4,115,857; 4,492,059; 4,416,091; 4,596,092 and 4,615,150.

With the generalized advent of the high speed trains it is absolutely necessary to have perfect tracks which particularly present rails the whole rolling surface as well as the internal side of the head of the rail of which have no short or long ondulations, no burrs, no deformations and which have a transverse profile as close as possible to an optimal profile for the rolling of the trains.

Furthermore, a quick reprofiling necessitates a tool with a high rate of metal removal, for example a coarse grain grinding wheel, whereas for fine grinding another tool, for example a fine grain grinding wheel, is necessary. This leads to duplication of tools.

It is therefore pratically impossible with only one and the same reprofiling vehicle to restore a worn rail since to be able to grind all the side lines of the head of the rail which have to undergo a rectification the grinding units have to take such positions, to combine all the advantages described in the existing solutions indicated above, that it is practically impossible to locate them in the space available under the frame of the railroad vehicle while having a sufficient number of grinding units to reduce as much as possible the number of passes of the vehicle along a portion of the railroad track, what is necessary to avoid perturbation of the normal traffic on said railroad track portion.

According to the present invention, the railroad vehicle for the reprofiling of at least one rail of a railroad track comprises a frame provided with wheels resting on each of the rails and at least two reprofiling units having each a motor the shaft of which carries at each end a reprofiling tool. This vehicle comprises further means for displacing the reprofiling units in height and transversally with respect to the frame as well as means to displace one of the tools of each grinding unit towards and awaY from the rail as well as to apply it against the rail. This railroad vehicle for reprofiling at least one rail of a railroad track is distinguished by the fact that it comprises a support connected to the frame of the vehicle and displaceable in respect therewith in a plane perpendicular to the longitudinal axis of the rail, and by the fact that at least two rotating tables are mounted on said support, each of said tables carrying a reprofiling unit.

The attached drawing shows schematically and by way of example, two embodiments of the railroad vehicle for reprofiling the rails of a railroad track according to the invention.

Figure 1:
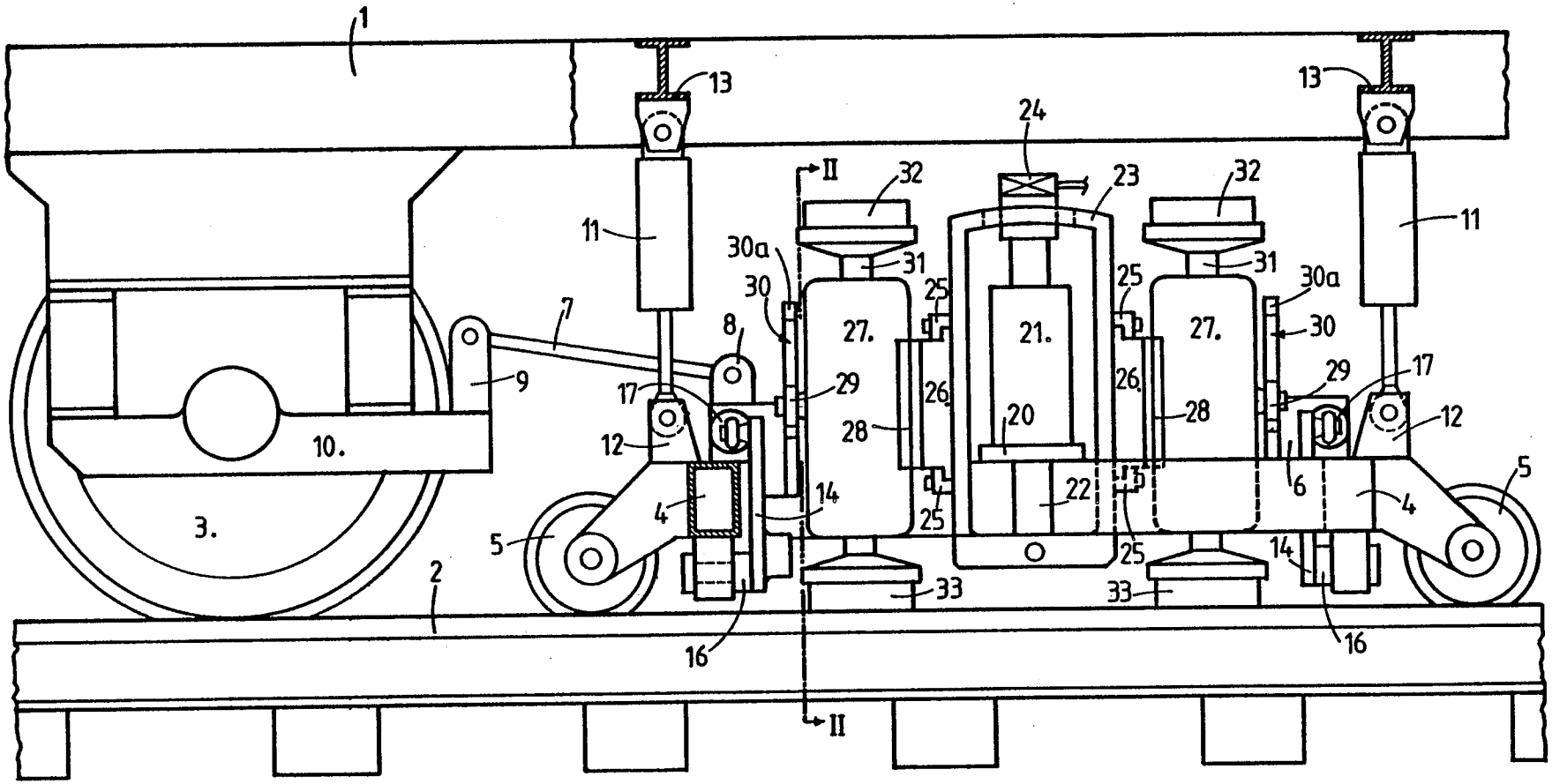
FIG. 1 is a partial side view of a first embodiment of the vehicle.
Figure 2:
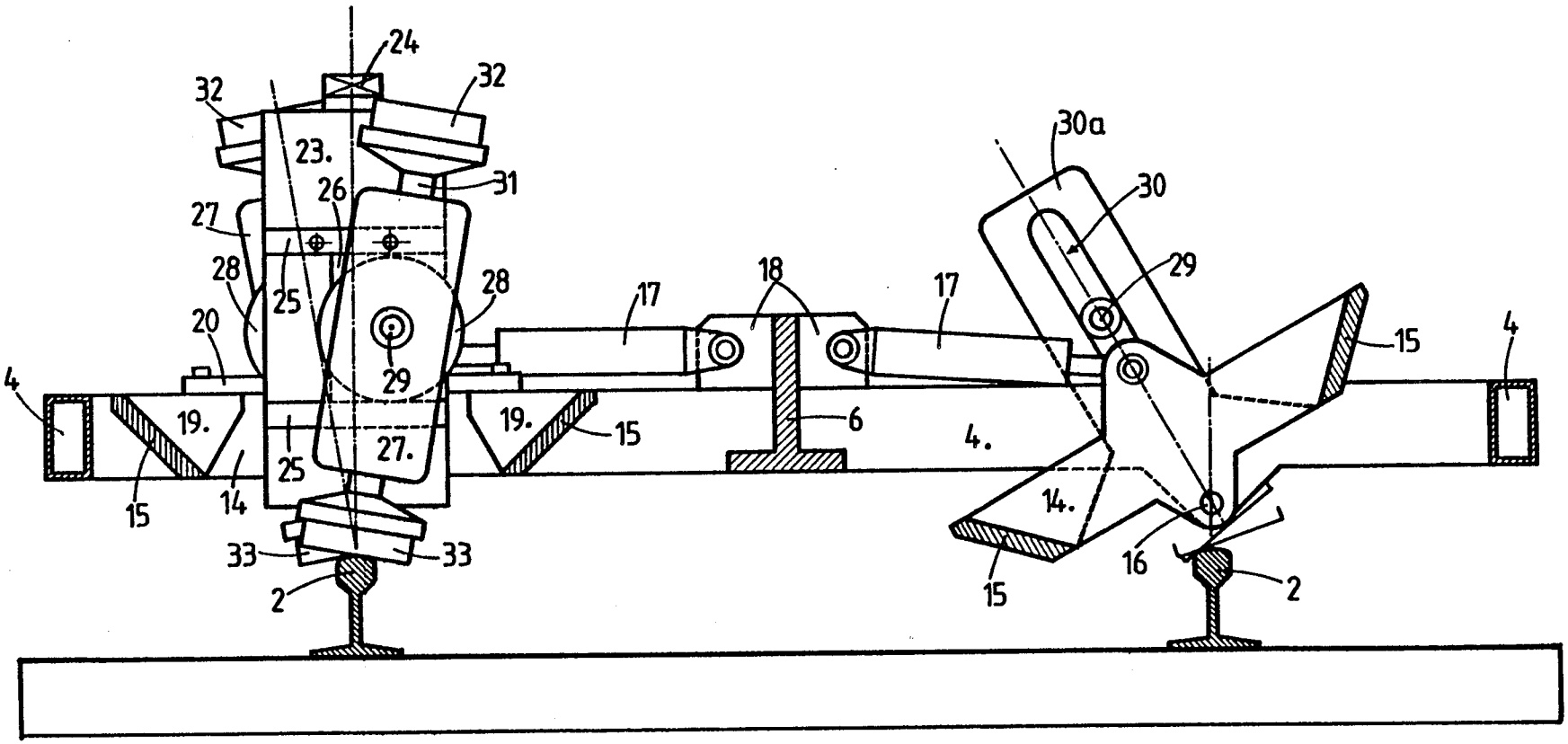
FIG. 2 is a partial cross section along line II—II of FIG. 1.

In the first embodiment shown in FIGS. 1 and 2, the railroad vehicle comprises a frame 1 resting on the rails 2 of the track through flanged wheels 3 and conventional suspensions.

This vehicle comprises, located between the rails 2 and the frame 1, a carriage formed by a framing 4, provided with flanged rollers 5 intended to roll on the rails 2, and a central beam 6. This carriage is mechanically connected to the frame 1 of the vehicle on the one hand by a rod 7 hinged on an extension 8 of the central beam and a part 9 on the bearing 10 of the axle of the vehicle wheel 3. This carriage is further connected to the frame 1 of the vehicle by means of lifting jacks 11 hinged on lugs 12 of the framing 4 and on crossbeams 13 of the frame 1 of the vehicle.

The jacks 11 enable vertically displacing the carriage 4,5,6 with respect to the frame 1 of the railroad vehicle either to lay it on the track through the intermediary of the rollers 5 during the grinding or to lift it out of engagement with the track to move without working, at great speed, to displace the vehicle from one grinding working place to another.

The rod 7, while permitting through its hinges the displacements in height of the carriage, ensures the pulling of the carriage 4,5,6 when it rests on the track.

A support or bed formed of two end plates 14 connected together by means of inclined edges 15 is pivoted on the carriage 4,5,6 around trunnions 16 having axes parallel to the longitudinal axis of the carriage and therefore of the frame 1 of the vehicle. These trunnions 16 are coaxial and located preferably in the plane of symmetry of the rail to which the bed is associated as well as in a horizontal plane. This support is connected to the central beam 6 of the carriage by two jacks 17 hinged respectively on each of the end plates 14 and on pads 18 fastened to said beam 6. This support can therefore be displaced angularly by these jacks 17 around an axis which is parallel to the axis of the vehicle of the carriage and therefore of the rail.

The central portion of the inclined edges 15 of the support comprises ribs 19 supporting a base plate 20 which carries the reprofiling unit.

In this embodiment the reprofiling unit mounted on the base plate 20 comprises a cylinder 21 fastened to the base plate 20 and traversed by the shaft 22 rigidly fixed at each of its ends emergency from the cylinder 21, to a framing 23. This shaft comprises further a piston (not shown) located within the cylinder 21 and separating it into two chambers which can either be fed with fluid under pressure or connected to the exhaust through the shaft 22 by means of servo valves 24 (only one of which is represented).

The cylinder 21 being fastened with the support 14, 15 the jack formed by the shaft 22 and its piston on the one hand and the cylinder 21 on the other hand enables reciprocating linear displacement of the framing 23 parallel to said shaft 22.

The sides of the framing 23, located in planes perpendicular to the longitudinal axis of the rail and hence also to the frame 1 of the vehicle, comprises slides 25, located in a plane perpendicular to this longitudinal axis, receiving the sliding blocks 26 which are actuated in their linear displacements within the slides 25 either manually or by means of jacks or other non illustrated means.

Each sliding block 26 carries a motor 27 by means of a rotating table 28 the angular displacements of which are controlled by incorporated motors not shown. Each motor 27 is provided with a roller 29 sliding in a slot 30 made in pads **30*a* fastened to the support 14, 15 avoiding in this manner any angular displacement of the reprofiling units around the shaft 22** during the reprofiling work.

Each motor 27 comprises a shaft 31 emerging from opposite sides of the motor housing and carrying at each of its ends a reprofiling tool, for example a grinding wheel 32, 33 fixed in a conventional, removable manner to said shaft 31.

The stroke of the framing 23 with respect to the support 14, 15 is sufficient so that when the grinding wheel 33 located adjacent or applied against the rail 2, is displaced away from said rail 2 by means of the jack 21, 22 only, the grinding wheel 33 will be sufficiently retracted to permit a rotation on itself of the motor 27, thanks to the rotating table 28, of 180° bringing the other grinding wheel 32 adjacent the rail 2.

Figure 5:
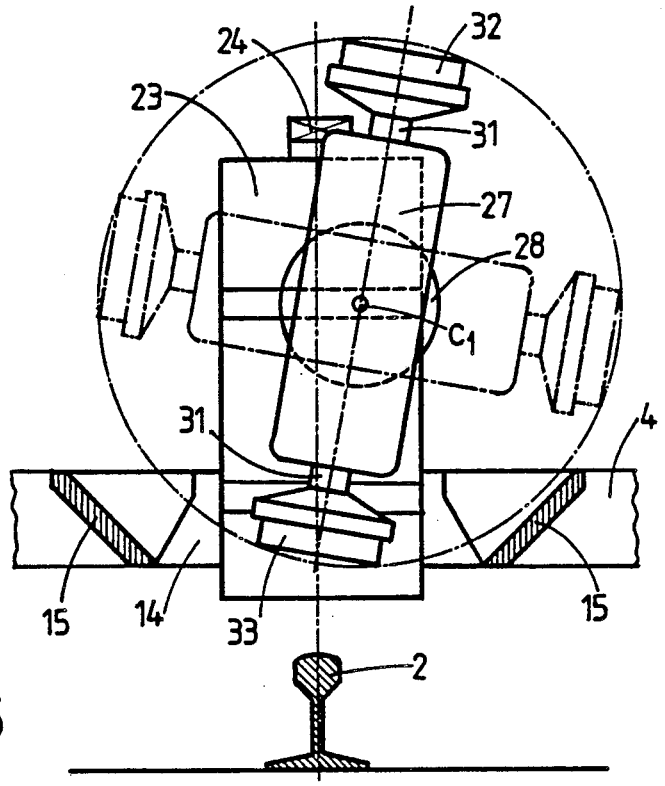
FIG. 5 is a partial cross section of the first embodiment showing a motor in upper position and its rotation around itself.

FIG. 5 shows a reprofiling unit in its upper position with respect to the framing 23 of the support. One sees that in this position the reprofiling unit can be pivoted around the axis of the rototable table 28 either to set it in an intermediate position (dashed lines) to replace the grinding wheel 32, 33 or to bring the grinding wheel 32 into contact with the rail in place of grinding wheel 33.

Figure 6:
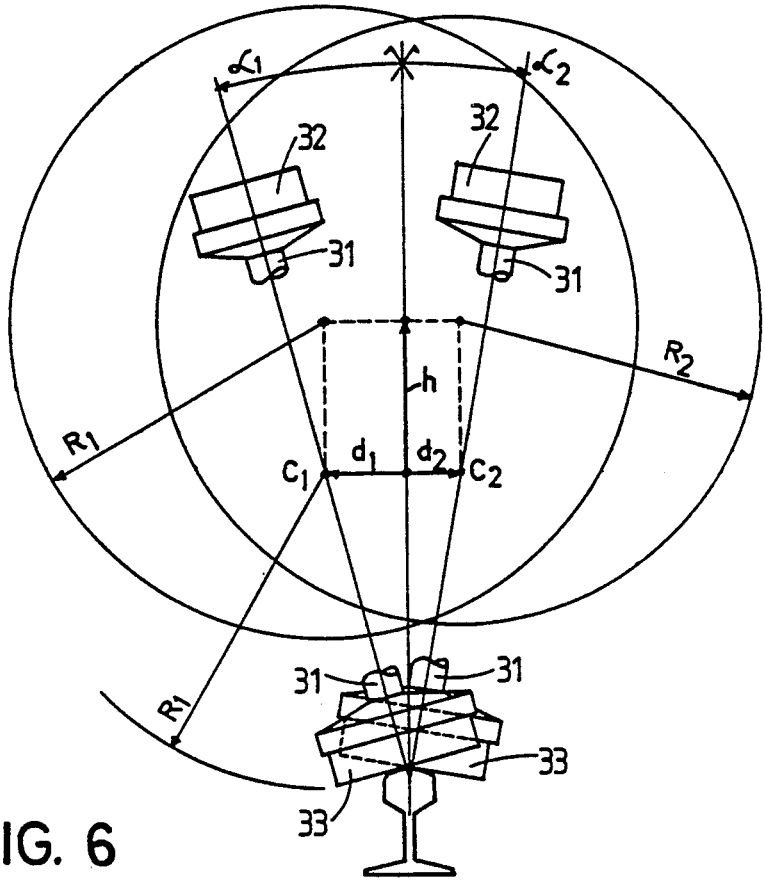
FIG. 6 shows a positioning scheme of two reprofiling units which are carried by a same support.

FIG. 6 shows schematically that the two reprofiling units carried by a same support can be positioned along angles $a_1$, $a_2$ are different. In this case, for the axis of the tool on work to be aligned on the side line of the rail having to be ground it is necessary that the lateral displacements $d_1$, $d_2$ obtained by the slides 25 are also different.

The centers of rotation $C_1$, $C_2$ of the rotatable tables 28 are asymmetrically located with respect to the support and the circumferences of radius $R_1$, $R_2$ swept by the reprofiling units during their movements are not superimposed.

In this embodiment the two reprofiling units are displaced simultaneously towards or away from the rail 2 by the same jack 21, 22 which also determines the pressure with which the tools of each of said reprofiling units are applied against the rail. The specific pressure of the tools against the rail can however be different from one reprofiling unit to the other particularly due to the shape and dimensions of the tool determining its contact area with the rail 2. This specific pressure depends also on the portion of the rail, rolling table or side, with which the tool is in contact. The tool of the two reprofiling units can further present different shapes or be of different kinds, grinding wheels, milling cutters, burr removers, etc.

In such an embodiment of a railroad vehicle for reprofiling the rails of a track the reprofiling units and their support members, bed and carriage, are extremely compact and can be lodged in great number under the frame of the vehicle.

These reprofiling units can be lifted for light running or lowered for reprofiling the rails.

The reprofiling units carried by a same support 14, 15 can be inclined around an axis which is parallel to the longitudinal axis of the vehicle, or can he inclined individually by means of the rotating tables 28 or simultaneously through the tilting of the support 14, 15 around the trunnions 16.

These reprofiling units are further displaceable in a plane transverse with respect to the longitudinal axis of the vehicle thanks to the slides 25 which can be rectilinear or curved.

Finally, these reprofiling units can be moved towards the rail, applied against it with a determined force or moved away from the said rail in order to be rotated about 180° to place the second tool in working position.

It is evident that all these displacements can be controlled either manually or automatically by means of a hydro-electric control systems for example according to a program determined as a function of the graph of the defects measured along the portions of rail to be reprofiled.

Furthermore, it is possible to provide locking systems, for example electro-magnetic systems, to rigidly fix the position chosen for the turning tables 28 and the sliding blocks 26 in the slides 25 so as to avoid anY vibration of the reprofiling units at work. The locking and the unlocking of these systems can be controlled manually or automatically.

All the manual or automatic controls are located in the driving cabin of the vehicle.

Finally during their rotation on themselves the motors 27 can be stopped and locked in an intermediate position, one of the tools being directed laterally towards the outside of the vehicle to facilitate its replacement.

In non-illustrated variants it is evident that a same support 14, 15 could carry several groups of two reprofiling units actuated by a central jack 21, 22.

In the example shown, the turning tables 28 are adjacent to the corresponding motors 27 whereas the slides 25 are adjacent to the framing 23 of the support. This positioning can of course be reversed. In this case if the angles and between the axis of the motors 27 and the axis 22 are equal, when the motors are reversed by 180° they occupy positions which are symmetrically opposed with respect to said axis 22.

In practice, the axis of the trunnions 16 pivoting the support 14, 15 are lowered so that the distance with respect to the rail 2 is as small as possible. In this manner, the angular tilting of the support 14, 15 causes a small lateral displacement only of the rotation axis of the tools.

It is possible to provide for a transverse displacement of the axis 16 with respect to the carriage 14, 15 as for example in the embodiment described in patent CH 666.068.

In other variants, the axis of rotation of the turning tables 28 may not be parallel to the longitudinal axis of the vehicle, particularly when using peripheral grinding wheels or tools having special shapes.

A further advantage for using reprofiling units having a pivoting motor is that the protection rings (not shown) surrounding the rotative tools and avoiding the projection of portions of them in case of their splitting off, can be fixed to the motor and revolve therewith. So the tool which is not working, but which still revolves is also protected.

Figure 3:
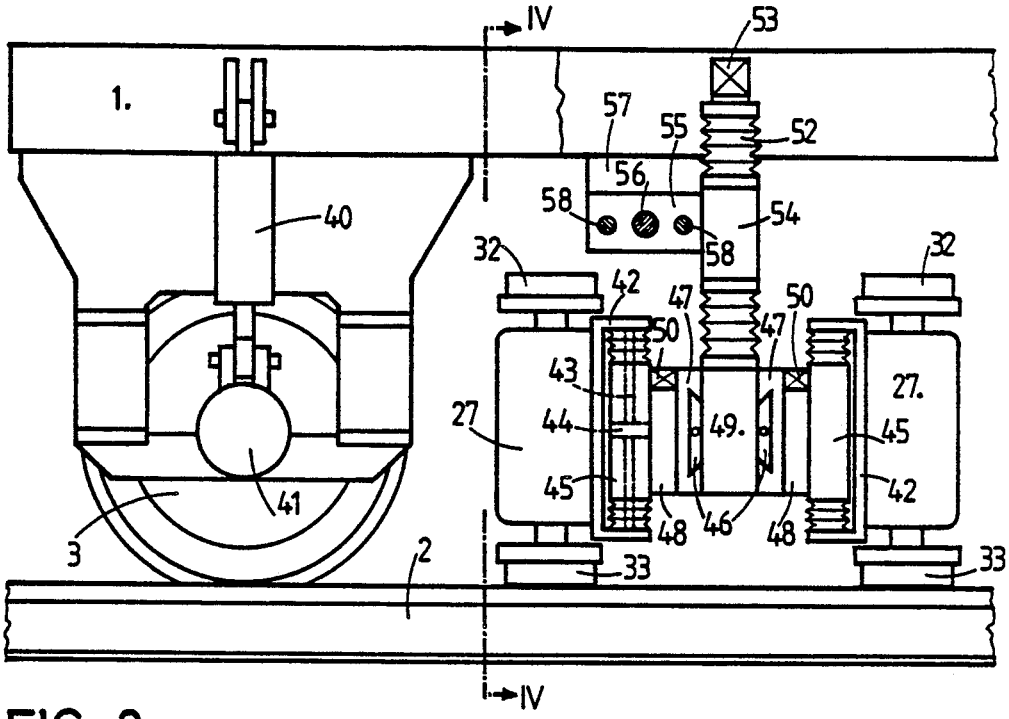
FIG. 3 is a partial side view of a second embodiment of the vehicle.

In the second embodiment of the reprofiling railroad vehicle for the rails of a track, shown in FIG. 3, the frame 1 of the vehicle is also provided with shaft and suspension and rests on the rails 2 by means of flanged wheels 3. In this embodiment, the vehicle comprises locking devices enabling disabling the suspension thereby to fix the shaft the wheels 3 to the frame 1. These locking devices are here constituted by jacks 40 connecting directly the frame 1 of the vehicle to the bearings 41 of the shaft of the wheels 3. When the two chambers of this jack 40, located on either side of a piston, are connected to the exhaust the suspension of the vehicle is operative permitting a fast speed of the vehicle. During the reprofiling of the rails on the contrary the two chambers of the jack 40 fed with fluid under pressure are closed forming then a rigid connection between the shaft of the wheels 3 and the frame 1.

In this embodiment each reprofiling unit is also constituted by a motor 27 the shaft of which carries at each end a grinding wheel 32, 33 or a rotating tool.

Each motor 27 is fastened with a stirrup 42 the wings of which are connected by means of a shaft 43 provided in its center with a piston 44 slidingly mounted within a cylinder 45. Flexible projections protect the parts of the shaft emerging from opposite sides of the cylinder 45. This cylinder 45 is fastened to a sliding block 46 sliding in a slide 47 fastened to the turning plate of a rotating table 48 fastened to a support 49.

The slide 47 is rectilinear, a shaped along an arc of circle or curved along any other curve and is located in a plane perpendicular to the longitudinal axis of the vehicle (i.e. transversely with respect to the axis of the track).

The jack constituted by the piston 44 and the cylinder 45 enables displacing the reprofiling unit towards or away of the rail, the support 49 being fixed, and to apply either tool 32 or 33 with a determined force, which is fixed or variable, against the rail 2.

The turning table 48, actuated by a motor 50, enables on the one hand to revolving the reprofiling unit by 90°, to replace a worn out tool, or by 180°, to replace the tool working on the rail by the second tool of the reprofiling unit. This turning table 48 permits also inclining the axis of the reprofiling unit with respect to the vertical to have the tool enter into contact with the rail at different side lines of the head of the rail.

Figure 4:
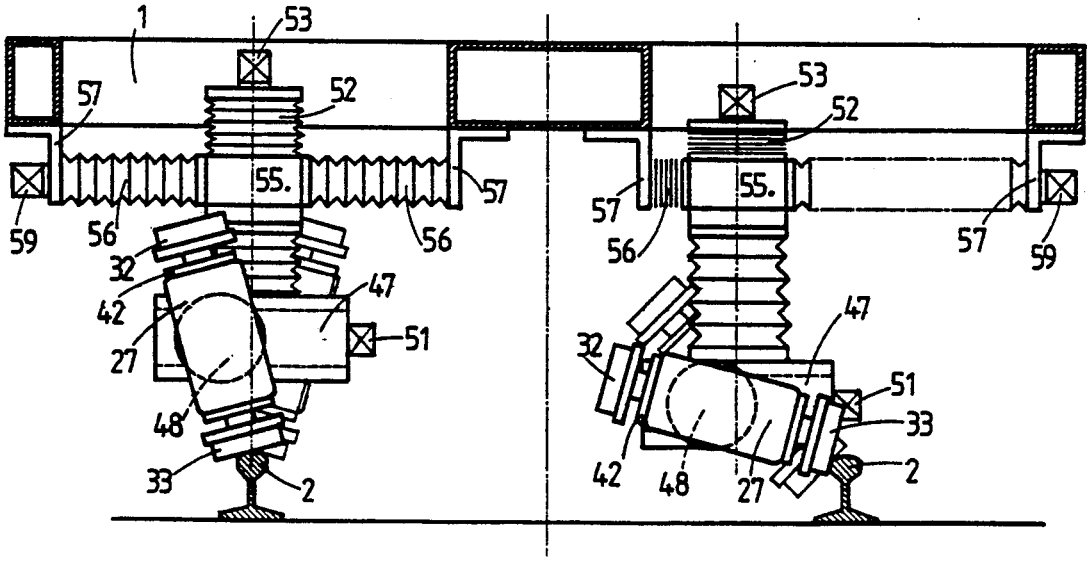
FIG. 4 is a partial cross section along line IV—IV of FIG. 3.

The sliding block 46, also actuated by a motor 51 and a screw, enables to placing the reprofiling unit in a plane transverse to the longitudinal axis of the vehicle, i.e. of the rail and thus for certain inclinations of the axis of the reprofiling unit to position the tool in an optimal position with respect to the rail to be reprofiled. This is particularly necessary for rectifying the internal and external sides of the head of the rail 2 (FIG. 4, right part).

Furthermore, the support 49 is itself displaceable with respect to the frame 1 of the vehicle firstly in height and secondly horizontally perpendicularly to the longitudinal axis of the vehicle. In fact, this support 49 is pivoted on the end of a screw 52, driven in rotation by a motor 53 and meshing with a nut 54. This nut 54 is fastened with a nut 55 meshing with a screw 56 pivoted in brackets 57 fastened to the frame 1 To avoid any rotation of the nut 55 around the endless screw 56, nut 55 slides along guides 58 extending, on either side of the screw 56, between the brackets 57. This screw 56 is driven by a motor 59.

So the support 49, and the two reprofiling units it carries, can be displaced in height and transversely with respect to the frame 1 of the vehicle permitting the optimal positioning of the support 49 to thereafter by means of the rotating table 48 and of the slide 46, 47 position the reprofiling units with respect to the rail side lines they have to work on.

In this embodiment, the omission of the carriage is possible thanks to the locking devices of the suspension of the vehicle which then constitutes itself this carriage.

In this second embodiment too only one support 49, displaceable in height and transversely with respect to the frame 1 of the vehicle, carries two reprofiling units, each formed of a motor 27 and of two rotative tools 32, 33 themselves displaceable with respect to the said support 49 on the one hand angularly and in translation in a plane perpendicular to the longitudinal axis of the rail and on the other hand linearly parallel to the shaft of motor 27, i.e. to the axis of said reprofiling unit.

This construction is very compact and garantees an easy accessibility to the reprofiling units even if a great number of pairs of reprofiling units are disposed under the frame 1 of the railroad vehicle.

I claim:

1. Railroad vehicle for the reprofiling of at least one rail of a railway track comprising a frame provided with wheels resting on each rail; at least two reprofiling units having each a motor having an output shaft which carries at each end a rotative tool; a support carrying said at least two reprofiling units; connecting means connecting said support to said frame and permitting displacing said support vertically and transversely with respect to said frame; said reprofiling units comprising further means to apply one of their tools against a rail; said support being displaceable with respect to said frame in at least one of rotation and translation; and in which each said reprofiling unit is mounted on said support by means of a rotating table the rotation axis of which is perpendicular to the axis of rotation of the motor of said reprofiling unit and by means of a slide extending perpendicularly to the longitudinal axis of the rail so that the motor shafts of the motors of said at least two reprofiling units can be displaced the one with respect to the other, firstly, in rotation around an axis parallel to the longitudinal axis of the rail, and secondly, in translation parallel to a plane which is perpendicular to the longitudinal axis of the rail.

2. Vehicle as claimed in claim 1, in which said support is pivotally mounted along an axis parallel to the longitudinal axis of the rail on a carriage provided with wheels to be pulled along the track.

3. Vehicle according to claim 2, in which said support carries the cylinder of a jack having an axis perpendicular to the axis of pivoting of the support, said jack having a piston which is fastened to a shaft the ends of which are fixed to a frame, this frame carrying said two said reprofiling units by means of turning tables and slides.

4. Vehicle according to claim 1, in which said support is connected to said frame directly by lifting and translating means; this support carrying two said reprofiling units by means of the said rotating tables and slides; as well as jacks displacing each reprofiling unit parallel to its longitudinal axis.

* * * * *